US009969477B2

(12) United States Patent
Okuda

(10) Patent No.: US 9,969,477 B2
(45) Date of Patent: May 15, 2018

(54) ENGINE CONTROL DEVICE

(71) Applicant: Yanmar Co., Ltd., Osaka-shi, Osaka (JP)

(72) Inventor: Hiroyuki Okuda, Osaka (JP)

(73) Assignee: Yanmar Co., Ltd., Osaka-Shi, Osaka (JP)

( * ) Notice: Subject to any disclaimer, the term of this patent is extended or adjusted under 35 U.S.C. 154(b) by 0 days. days.

(21) Appl. No.: 15/316,479

(22) PCT Filed: Jun. 2, 2015

(86) PCT No.: PCT/JP2015/002789
§ 371 (c)(1),
(2) Date: Dec. 5, 2016

(87) PCT Pub. No.: WO2015/186353
PCT Pub. Date: Dec. 10, 2015

(65) Prior Publication Data

US 2017/0203826 A1 Jul. 20, 2017

(30) Foreign Application Priority Data

Jun. 6, 2014 (JP) ..... 2014-117513

(51) Int. Cl.
*B63H 21/21* (2006.01)
*B63H 21/14* (2006.01)
(Continued)

(52) U.S. Cl.
CPC ..... *B63H 21/21* (2013.01); *B63H 21/14* (2013.01); *B63H 21/213* (2013.01); *B63H 21/32* (2013.01);
(Continued)

(58) Field of Classification Search
CPC ..... B63H 21/21; B63H 21/213; B63H 21/32; B63H 21/14; B63H 21/20; B63H 21/16;
(Continued)

(56) References Cited

U.S. PATENT DOCUMENTS

2011/0080040 A1* 4/2011 Kumar ..... B60K 6/46 307/9.1
2011/0196552 A1* 8/2011 Garon ..... B63H 21/21 701/21
(Continued)

FOREIGN PATENT DOCUMENTS

JP H03253494 11/1991
JP 2004137998 A 5/2004
(Continued)

OTHER PUBLICATIONS

International Search Report dated Aug. 25, 2015, for International Application No. PCT/JP2015/002789, ISA/JPO, Tokyo, Japan.

*Primary Examiner* — Lindsay Low
*Assistant Examiner* — George Jin
(74) *Attorney, Agent, or Firm* — Sterne, Kessler, Goldstein & Fox P.L.L.C.

(57) ABSTRACT

An engine control device is provided with a main operation unit, an auxiliary operation unit, a changeover switch, and an engine control unit. The main operation unit is capable of performing an operation of changing a rotation speed of a propulsion engine mounted on a ship. The auxiliary operation unit is capable of performing an operation of changing the rotation speed of the engine instead of the main operation unit. The changeover switch is capable of performing an operation of switching between a main ship handling state in which the rotation speed of the engine can be changed by operating the main operation unit and an auxiliary ship handling state in which the rotation speed of the engine can be changed by operating the auxiliary operation unit. The
(Continued)

engine control unit stops the engine when the changeover operation unit is operated to switch from the auxiliary ship handling state to the main ship handling state.

4 Claims, 7 Drawing Sheets

(51) Int. Cl.

| | |
|---|---|
| ***F02D 29/02*** | (2006.01) |
| ***F02D 41/04*** | (2006.01) |
| ***F02D 41/06*** | (2006.01) |
| ***B63H 21/32*** | (2006.01) |

(52) U.S. Cl.
CPC ..... *F02D 29/02* (2013.01); *F02D 41/042* (2013.01); *F02D 41/065* (2013.01); *B63B 2758/00* (2013.01); *B63B 2759/00* (2013.01); *B63H 2021/216* (2013.01)

(58) Field of Classification Search
CPC B63H 21/22; B63H 2021/216; B63H 20/001; B63H 2020/003; F02D 29/02; F02D 31/001; F02D 37/00; F02D 41/042; F02D 41/065; F02D 41/22; F02D 2041/227; F02D 2041/228; B63B 2759/00
See application file for complete search history.

(56) References Cited

U.S. PATENT DOCUMENTS

| | | | | |
|---|---|---|---|---|
| 2012/0083173 | A1* | 4/2012 | McMillan ..... | B63H 21/20 440/6 |
| 2014/0329422 | A1* | 11/2014 | Ito ..... | B63H 20/12 440/1 |

FOREIGN PATENT DOCUMENTS

| | | | |
|---|---|---|---|
| JP | 200799174 | A | 4/2007 |
| JP | 200887736 | A | 4/2008 |
| JP | 201048200 | A | 3/2010 |

* cited by examiner

FIG. 6

| LIGHTING PATTERNS | CONTENTS |
|---|---|
| OFF | IN MAIN SHIP HANDLING STATE, AND MAIN SHIP HANDLING SYSTEM IS IN SATISFACTORY CONDITION |
| CONTINUOUSLY | IN AUXILIARY SHIP HANDLING STATE, AND AUXILIARY SHIP HANDLING SYSTEM IS IN SATISFACTORY CONDITION |
| 0.5Hz | POWER RESOURCE "OFF", AND ENGINE CONTROL UNIT IS IN PROCESS |
| 1Hz | MAIN SHIP HANDLING SYSTEM IS IN GRADUAL CHANGE PROCESS |
| 2.5Hz | SWITCHING TO AUXILIARY SHIP HANDLING SYSTEM AND IN STANDBY STATE |
| 5Hz | BOTH OF THE SYSTEMS ARE INVALID, OR AUXILIARY SHIP HANDLING SYSTEM IS IN GRADUAL CHANGE PROCESS |

ENGINE CONTROL DEVICE

TECHNICAL FIELD

The present invention relates to an engine control device for operating a rotation speed of an engine mounted on a ship.

BACKGROUND ART

Conventionally, a ship is provided with a main operation unit that is for operating a rotation speed of an engine mounted thereon. The main operation unit is connected to an engine control unit (ECU) that is for controlling the engine. The ship's operator can change the rotation speed of the engine by operating this main operation unit.

There are cases when an auxiliary operation unit is provided with the ship in addition to the main operation unit. The auxiliary operation unit is provided for operating the rotation speed of the engine instead of the main operation unit when the main operation unit is in an unsatisfactory condition. Patent Document 1 discloses an engine rotation speed control device in which these types of two operation units are provided.

In the engine rotation speed control device of Patent Document 1, the engine control unit is configured to be capable of detecting that disconnection occurs between a remote control lever (a main operation unit) and the engine control unit. When this disconnection is detected and other predetermined conditions are satisfied, the engine rotation speed control unit controls such that the engine rotation speed can be operated by an auxiliary throttle dial (an auxiliary operation unit).

PRIOR-ART DOCUMENTS

Patent Documents

Patent Document 1: Japanese Patent Application Laid-Open No. 2004-137998

SUMMARY OF THE INVENTION

Problems to be Solved by the Invention

However, while a control for switching from a state where the ship is operable by operating the main operation unit (a main ship handling state) to a state where the ship is operable by operating the auxiliary operation unit (an auxiliary ship handling state) is disclosed in Patent Document 1, a reverse control, that is, a control for switching from an auxiliary ship handling state to a main ship handling state, is not disclosed in Patent Document 1. Accordingly, it is possible that a trouble occurs when the ship handling state is switched from the auxiliary ship handling state to the main ship handling state. For example, there are cases when the ship handling state is switched from the auxiliary ship handling state to the main ship handling state while the clutch is kept engaged. When the ship handling state is switched from an auxiliary ship handling state to the main ship handling state in the state where the abnormal condition is not dissolved, the possibility of occurrence of a trouble is further increased.

The present invention has been made in view of the circumstances described above, and a primary object is to provide an engine control device that can surely prevent the occurrence of a trouble when switching from an auxiliary ship handling state to a main ship handling state.

Means for Solving the Problems and Effects Thereof

Problems to be solved by the present invention are as described above, and next, means for solving the problems and effects thereof will be described.

In an aspect of the present invention, an engine control device is provided as follows. That is, the engine control device includes a main operation unit, an auxiliary operation unit, a changeover operation unit, and a control unit. The main operation unit is capable of performing an operation of changing a rotation speed of a propulsion engine mounted on a ship. The auxiliary operation unit is capable of performing an operation of changing the rotation speed of the engine instead of the main operation unit. The changeover operation unit is capable of performing an operation of switching between a main ship handling state in which the rotation speed of the engine can be changed by operating the main operation unit and an auxiliary ship handling state in which the rotation speed of the engine can be changed by operating the auxiliary operation unit. The control unit stops the engine when the changeover operation unit is operated to switch from the auxiliary ship handling state to the main ship handling state.

Accordingly, since the engine comes to a stop by the control unit, the occurrence of a trouble when switching from the auxiliary ship handling state to the main ship handling state is surely prevented. For example, switching the ship handling state while a clutch is kept engaged can be prevented.

The above-described engine control device is preferably configured as follows. That is, the control unit stops the engine and shuts off at least a power source of the control unit when the changeover operation unit is operated to switch from the auxiliary ship handling state to the main ship handling state.

That is, when the ship handling state is switched from the auxiliary ship handling state to the main ship handling state, it is generally considered that an unsatisfactory condition is dissolved and now a main ship operation-side and a control unit-side can communicate satisfactory. Accordingly, the occurrence of an electric trouble or a failure on a program can be prevented by at least shutting down the power source of the control unit and restarting the control unit.

The above-described engine control device is preferably configured as follows. That is, when the control unit starts the engine after stopping the engine, if the control unit determines that the main operation unit is in a satisfactory condition, the ship handling state is set to the main ship handling state, whereas if the control unit determines that the main operation unit is not in a satisfactory condition, the ship handling state is set to the auxiliary ship handling state.

Accordingly, whether the ship handling state is set to the main ship handling state or the auxiliary ship handling state is automatically determined based on the condition of the main operation unit. Because of this configuration, even supposing that the ship handling state is switched from the auxiliary ship handling state to the main ship handling state while an unsatisfactory condition of the main operation unit is not dissolved, the ship handling state can be automatically returned to the auxiliary ship handling state.

The above-described engine control device is preferably configured as follows. That is, at least two propulsion engines mounted on the ship are provided. When the control unit determines that the operation of the main operation unit toward one of the engines cannot be performed satisfactory, the control unit reduces the rotation speed of said engine, while reducing the rotation speed of the other engine.

Accordingly, reduction of rotation speed of merely the one engine can be prevented. Accordingly, for example, outputs of two propulsion devices can be uniformed.

BRIEF DESCRIPTION OF THE DRAWINGS

FIG. 6. A table showing lighting patterns of an alarm lamp and the contents in which each lighting pattern indicates.

EMBODIMENT FOR CARRYING OUT THE INVENTION

Figure 1:
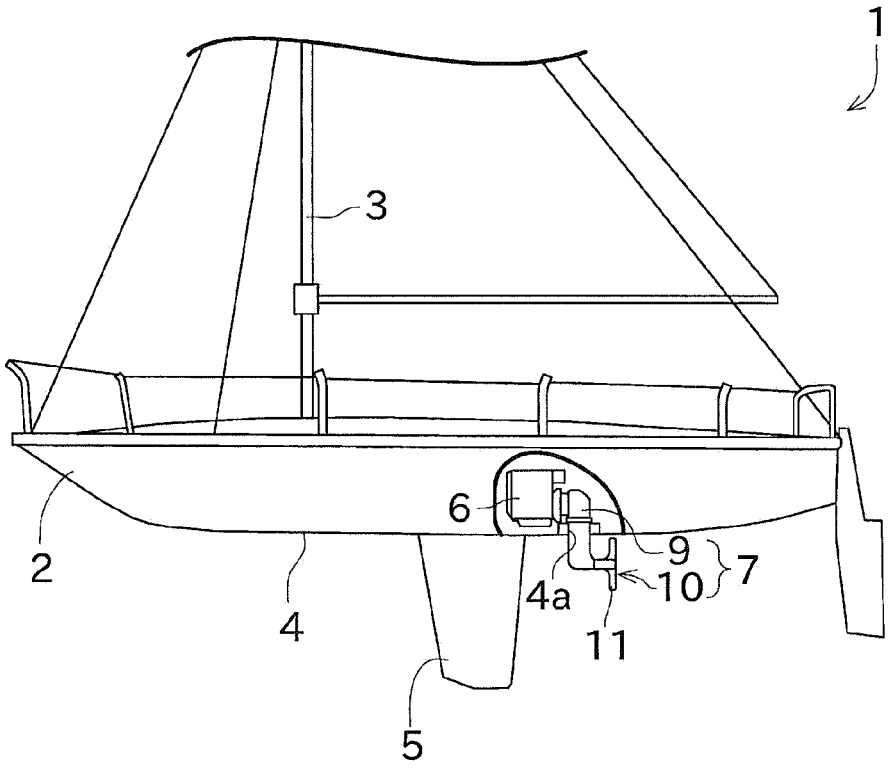
FIG. 1. A schematic side view illustrating a ship and its propulsion mechanism.

Next, an embodiment of the present invention will be described with reference to the drawings. FIG. 1 is a schematic side view illustrating a ship and its propulsion mechanism.

As illustrated in FIG. 1, a ship 1 is a sailing ship having a fore-and-aft sail. A mast 3 is put in a standing position on a body 2 of the ship 1, and a sail is set to the mast 3. A center board 5 for stabilizing the position of the ship 1 is formed on a ship bottom 4.

An engine 6 and a propulsion device 7 are mounted on the ship 1 as a propulsion mechanism. The engine 6 is arranged inside the body 2 of the ship 1. The engine 6 is a diesel engine having a common-rail-type fuel injection device. The propulsion device 7 is connected to a rear end of the engine 6.

The propulsion device 7 is arranged near an opening portion 4*a* of the ship bottom 4. The propulsion device 7 is configured from an upper unit 9 and a lower unit 10. The upper unit 9 is arranged inside the body 2 of the ship 1. The upper unit 9 is connected to the engine 6. The lower unit 10 includes a propeller 11 and a rudder (not shown). The propeller 11 and the rudder are arranged so as to extend from the opening portion 4*a* of the ship bottom 4 into the water. As described above, an installation configuration of so-called inboard-outdrive engine is used in this embodiment.

With this configuration, the propeller 11 is driven by using the power generated by the engine 6, and thereby the ship 1 can be moved.

Figure 2:
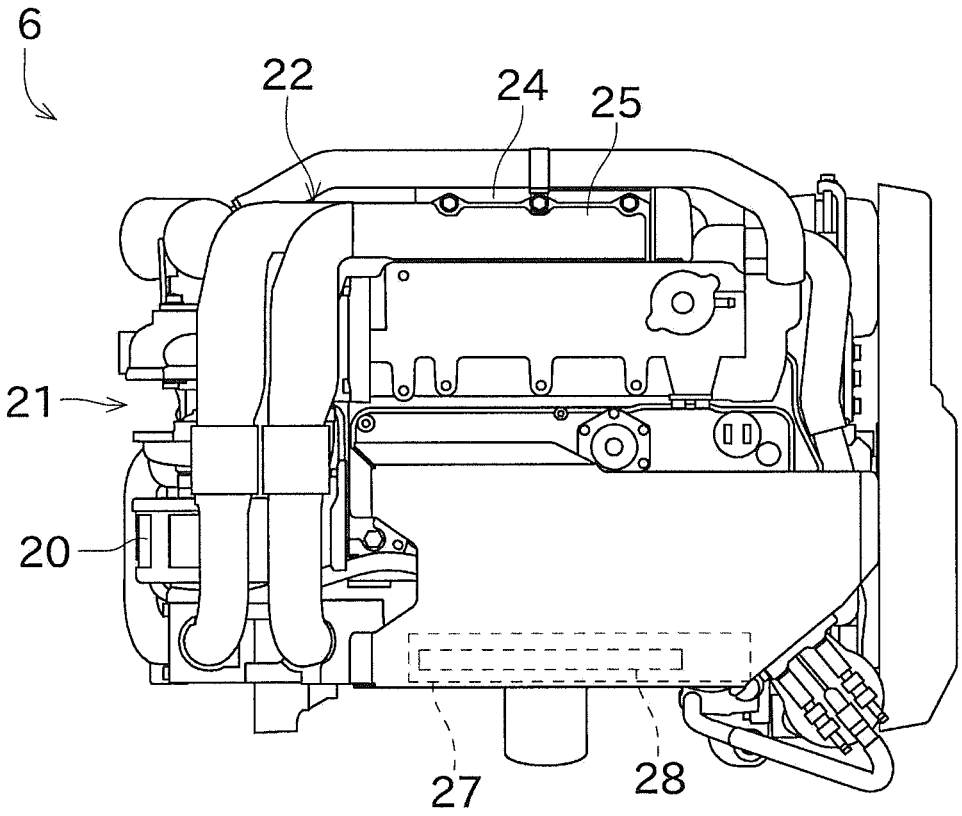
FIG. 2. A schematic plane view of an engine.
Figure 3:
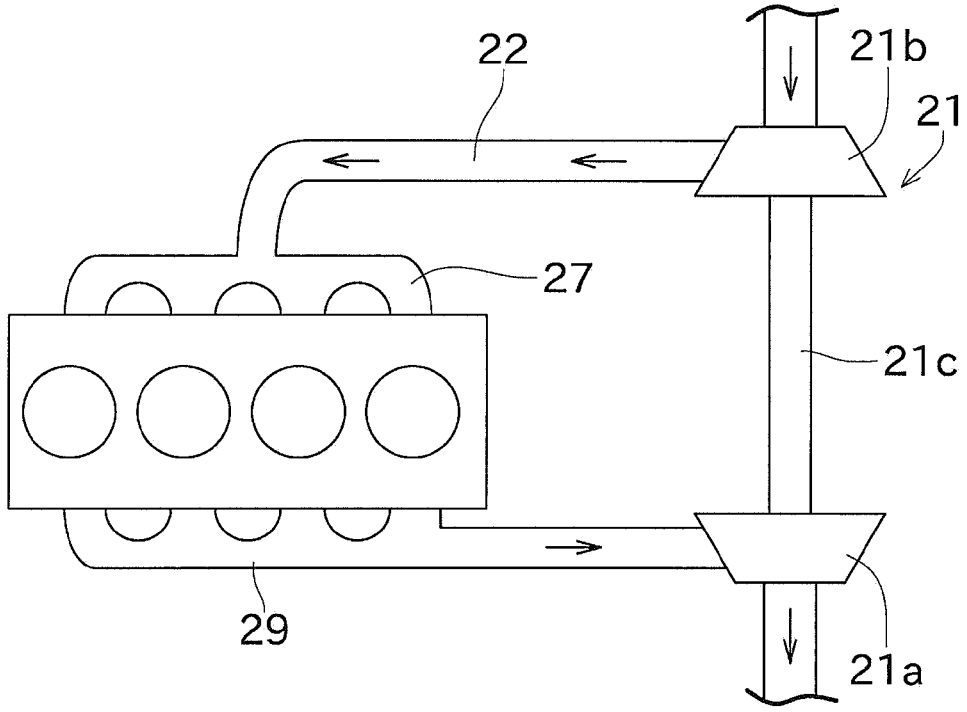
FIG. 3. An explanatory drawing schematically illustrating a flow of an intake air and exhaust air.

Next, a configuration of the engine 6 will be briefly described with reference to FIG. 2 and FIG. 3. FIG. 2 is a schematic plane view of the engine 6. FIG. 3 is an explanatory drawing schematically illustrating a flow of an intake air and exhaust air.

As illustrated in FIG. 2, the engine 6 includes an intake part 20, a turbocharger 21, an intake pipe 22, an inter cooler 24 and a fresh water cooler 25.

The intake part 20 takes the outside air into the engine 6. An air cleaner is arranged inside the intake part 20. Dust particles etc. included in the intake air are taken away by the air cleaner. As illustrated in FIG. 3, the turbocharger 21 includes a turbine wheel 21*a* and a compressor wheel 21*b*. The turbine wheel 21*a* is configured to be rotated utilizing the exhaust gas. The compressor wheel 21*b* is connected to the same shaft 21*c* as the turbine wheel 21*a*. The compressor wheel 21*b* rotates together with the rotation of the turbine wheel 21*a*. Accordingly, due to the rotation of the compressor wheel 21*b*, the air is compressed and the intake air is compulsorily taken in.

The intake pipe 22 connects the intake part 20 and the turbocharger 21 with the inter cooler 24. After flowing inside the intake pipe 22, the intake air is cooled down by the inter cooler 24. The inter cooler 24 cools down the intake air taken in by the intake part 20 and the turbocharger 21 through heat exchange with the water (in this embodiment, seawater) taken in from outside the ship. The seawater is, after utilized for heat exchange in the inter cooler 24, is further heat exchanged with the cooling water in the fresh water cooler 25, and then the seawater is exhausted outside the ship.

After cooled down by the inter cooler 24, the air is supplied to an intake manifold 27 shown in FIG. 3 through the intake pipe 22. The intake manifold 27 distributes the air supplied from the intake pipe 22 corresponding to the number of cylinders, and thereby supplies the air to the combustion chambers.

As illustrated in FIG. 2, a common rail 28 is provided near the intake manifold 27. The common rail 28 stores the fuel supplied from a fuel tank (not shown) at high pressure, and supplied the fuel to injectors. In the combustion chambers, after the air supplied from the intake manifold 27 is compressed, the fuel is injected from the injectors. Accordingly, combustion is generated inside the combustion chambers, and pistons can be moved vertically. The power generated as described above is transmitted to the propulsion device 7 through a crankshaft, etc.

After the exhaust gas generated in combustion chambers are gathered in the exhaust manifold 29, the exhaust gas passes through the turbine wheel 21*a* of the turbocharger 21 and then is exhausted.

Figure 4:
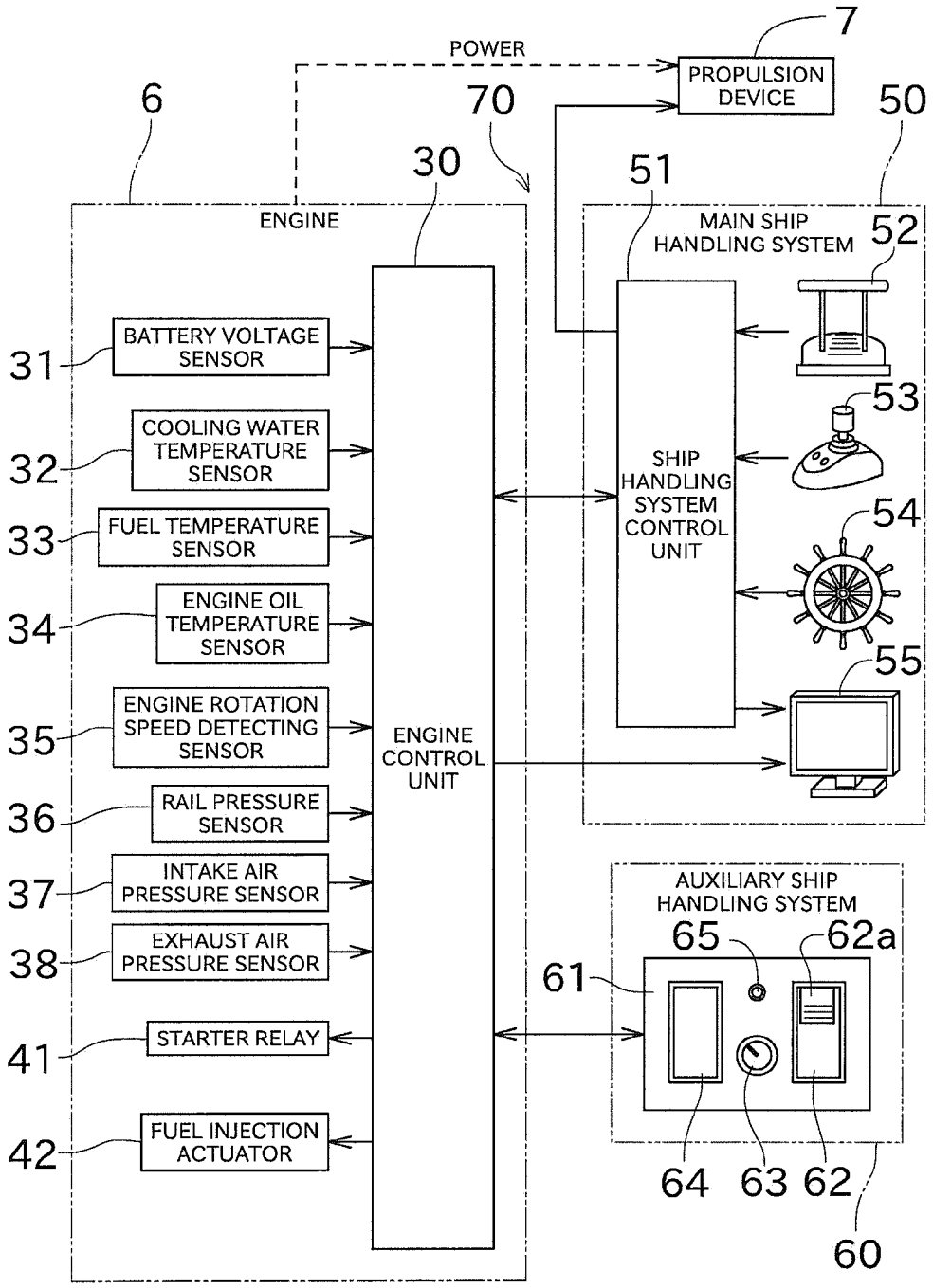
FIG. 4. A functional block diagram of the engine and a ship handling system.

Next, an electric configuration of the engine and an engine control device will be described. FIG. 4 is a functional block diagram of the engine 6 and a ship handling system.

An engine control unit (ECU, control unit) 30 includes, for example, a CPU, a ROM, a RAM, etc. Programs stored in the ROM is read to the RAM by the CPU of the engine control unit 30, and thereby various kinds of controls are performed. For example, the engine control unit 30 activates control target members (such as actuators) included in the engine 6, records errors, and informs the errors based on information detected by various kinds of sensors. Hereinafter, one example of the sensors and the control target members will be described briefly.

The engine 6 includes, as an example of the sensors, a battery voltage sensor 31, a cooling water temperature sensor 32, a fuel temperature sensor 33, an engine oil temperature sensor 34, an engine rotation speed detecting sensor 35, a rail pressure sensor 36, an intake air pressure sensor 37, and an exhaust air pressure sensor 38.

The battery voltage sensor 31 detects a voltage of a battery. The battery voltage sensor 31 can detect the voltage of the battery not only while the engine 6 is operated, but also before the engine 6 is started.

The cooling water temperature sensor 32 is arranged inside a cooling water tank or a cooling water pipe. The cooling water temperature sensor 32 detects the temperature of the cooling water. If the temperature of the cooling water is high, it is possible that the fresh water cooler 25 has broken down, or the engine 6 has been overheated. The fuel temperature sensor 33 is provided in a fuel pipe, a fuel pump or the like. The fuel temperature sensor 33 detects the temperature of the fuel. If the temperature of the fuel is too high, the seal members and the like may be deteriorated. The engine oil temperature sensor 34 detects the temperature of the engine oil. The engine oil temperature sensor 34 is arranged in an oil pipe, an oil pan, or the like, and detects the temperature of the engine oil. If the temperature of the engine oil is too high, lubricating function may not be exerted sufficiently.

The engine rotation speed detecting sensor 35 detects the rotation speed (engine speed) of the engine 6. In this Description, the number of rotations of the engine at a predetermined time (that is, engine speed) is simply referred to as "rotation speed of an engine". The rail pressure sensor 36 detects the pressure of the fuel inside the common rail 28. If the pressure of the common rail 28 is high, it is possible that the pressure is not sufficiently controlled, and injection of fuel may not be performed appropriately. The intake air pressure sensor 37 is provided in the intake manifold 27 or the like, and detects the intake air pressure. The exhaust air pressure sensor 38 is provided in the exhaust manifold 29 or the like, and detects the exhaust air pressure. If the intake air pressure and the exhaust air pressure are abnormal, it is possible that the intake air or the exhaust air has been leaked.

The engine 6 includes, as an example of control target members, a starter relay 41 and a fuel injection actuator 42.

The starter relay 41 drives a starter motor so as to start the engine 6. The engine control unit 30 determines, after receiving an instruction of starting the engine, whether the voltage of the battery is equal to or more than a predetermined threshold value based on detection result of the battery voltage sensor 31. If the voltage of the battery is equal to or more than the predetermined threshold value, the engine control unit 30 does not turn on the electricity to the starter relay 41 (as a result, the engine 6 does not start). With this configuration, even if a battery that has a different voltage value is installed by mistake, high voltage is not supplied to the starter motor. Accordingly, damages in the starter motor can be prevented.

The fuel injection actuator 42 is configured from, for example, solenoid valves that are for injecting fuel from the injectors. The fuel injection actuator 42 (solenoid valves) open and close corresponding to the instruction of the engine control unit 30 so as to inject fuel into the combustion chambers. Fuel injection amount and injection timing can be adjusted by controlling the injection actuator 42. With this configuration, adjustment of output, cleaning of exhaust gas, and reduction of noise etc. can be realized.

Next, a description will be given of the ship handling system. In this embodiment, the ship handling system includes a main ship handling system 50 and an auxiliary ship handling system 60. The main ship handling system 50 is used for handling the ship 1 in a normal condition. The auxiliary ship handling system 60 is used for handling the ship 1 in the case where the main ship handling system 50 does not function due to disconnection of a wire etc. Although the engine control unit 30 may be grasped as the engine control device, when referring to "engine control device" (reference numeral 70) in the description hereinafter, it shall be construed that it indicates a configuration having the main ship handling system 50 and the auxiliary ship handling system 60 in addition to the engine control unit 30.

The main ship handling system 50 includes a ship handling system control unit 51, a main operation unit 52, a joystick lever 53, a steering wheel 54, and a display device 55.

The ship handling system control unit 51 is configured from, in the same manner as the engine control unit 30, a CPU, a ROM, a RAM, etc. The ship handling system control unit 51 is connected to the engine control unit 30. The ship handling system control unit 51 and the engine control unit 30 can communicate with each other by utilizing a standard such as a CAN (Controller Area Network). Accordingly, the engine control unit 30 can determine whether or not the ship handling using the main ship handling system 50 is possible (whether or not it is in an unsatisfactory condition) based on whether or not the engine control unit 30 can communicate with, for example, the ship handling system control unit 51 satisfactory.

The main operation unit 52 includes a handle. A rotation angle of the handle is outputted to the engine control unit 30 through the ship handling system control unit 51. The engine control unit 30 adjusts the fuel injection actuator 42 and the like based on the rotation angle of the handle of the main operation unit 52, whereby the rotation speed of the engine is changed.

The joystick lever 53 is configured operably in the front and rear directions. The operation performed by the joystick lever 53 is transmitted to the ship handling system control unit 51. The ship handling system control unit 51 gives instructions to the engine 6 or the propulsion device 7 corresponding to the operation.

If the joystick lever 53 is operated forward, the ship handling system control unit 51 gives instructions to the propulsion device 7 such that the propeller 11 is rotated to a direction that enables the ship 1 to be moved forward. On the other hand, when the joystick lever 53 is operated rearward, the ship handling system control unit 51 gives instructions to the propulsion device 7 such that the propeller 11 is rotated to a direction that enables the ship 1 to be moved rearward. If the joystick lever 53 is rotated, the ship handling system control unit 51 gives instructions to the propulsion device 7 such that the ship 1 is revolved on the spot.

When the joystick lever 53 is operated, the ship handling system control unit 51 sends a signal to an engine control unit 30 of the engine 6 corresponding to an inclined angle of the joystick lever 53. The engine control unit 30 changes the engine rotation speed corresponding to this inclined angle. Accordingly, not only the ship handling system control unit 51 but also the joystick lever 53 can be used for operating the engine rotation speed.

Moreover, not only the joystick lever 53 but also the steering wheel 54 can be used for operating a direction of progress of the ship 1. When the steering wheel 54 is rotated to a left-hand side or the right-hand side by the ship's operator, the ship handling system control unit 51 sends a signal to the propulsion device 7 corresponding to a rotation direction and a rotation amount of the steering wheel 54. The propulsion device 7 changes an angle of the rudder corresponding to this signal. Accordingly, the ship's operator can change the direction of progress of the ship 1.

The display device 55 can display a speed of the ship 1, the engine rotation speed, a mileage, and error information etc. based on signals received from the engine control unit 30 and the ship handling system control unit 51.

The auxiliary ship handling system 60 includes an auxiliary operation panel 61. A changeover switch (changeover operation unit) 62, an auxiliary operation unit 63, an engine switch 64, and an alarm lamp 65 are disposed on the auxiliary operation panel 61. The auxiliary operation panel 61 is connected to the engine control unit 30 in a wiring (analog wiring) different in system from the main ship handling system 50. Accordingly, the engine control unit 30 can determine whether or not the ship handling using the auxiliary ship handling system 60 is possible or not (whether or not it is in an unsatisfactory condition) based on whether or not the engine control unit 30 can communicate with, for example, the auxiliary operation panel 61 satisfactory.

The changeover switch 62 is a switch for switching between a state where the engine rotation speed is changed using the main operation unit 52 (a main ship handling state, the changeover switch is turned OFF), and a state where the engine rotation speed is changed using the auxiliary operation unit 63 (an auxiliary ship handling state, the changeover switch is turned ON). The ship handling state is switched from the main ship handling state to the auxiliary ship handling state by pressing the upper end of the changeover switch 62 toward the back side of the paper. The ship's operator can switch the ship handling state from the main ship handling state to the auxiliary ship handling state, in a state that a slide part 62*a* attached to the surface is slid to a lower side, by pressing an upper portion of the changeover switch 62. Wrong operation can be prevented by having the configuration of the slide part 62*a*.

The auxiliary operation unit 63 is a columnar sensor which is a dial-type operation unit (a dial) configured to be rotatable. During the auxiliary ship handling state, by means of rotating the auxiliary operation unit 63, the fuel injection actuator 42 etc. can be adjusted, whereby the engine rotation speed is changed. The engine switch 64 is a switch for switching between ON/OFF of the engine. The alarm lamp 65 is a lamp configured of a LED etc. Lighting pattern of the alarm lamp 65 is changed based on the operation state etc. (details will be described below).

Figure 5:
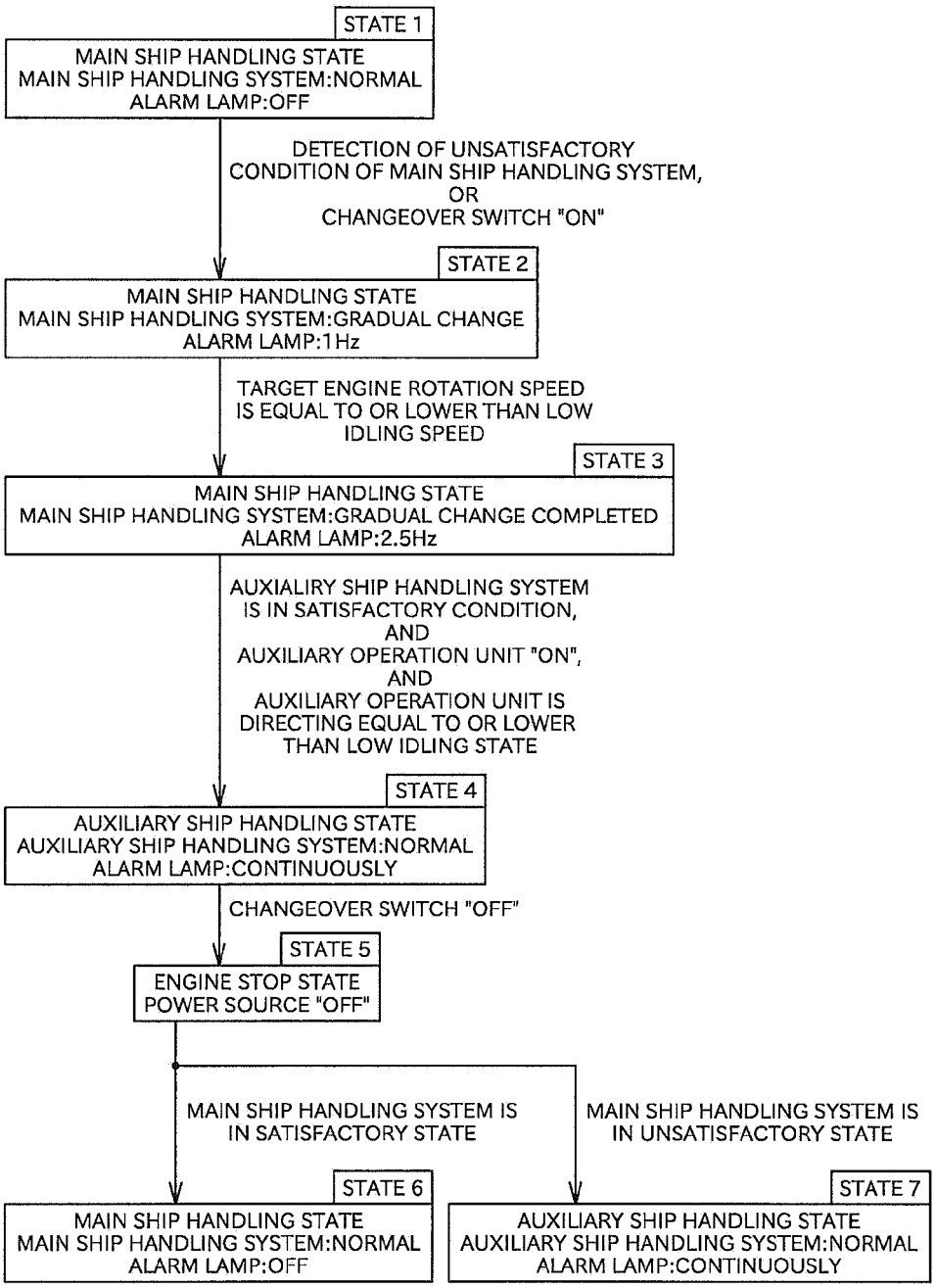
FIG. 5. An explanatory drawing showing a state change of an engine control device and processes accompanying the state change.
Figure 7:
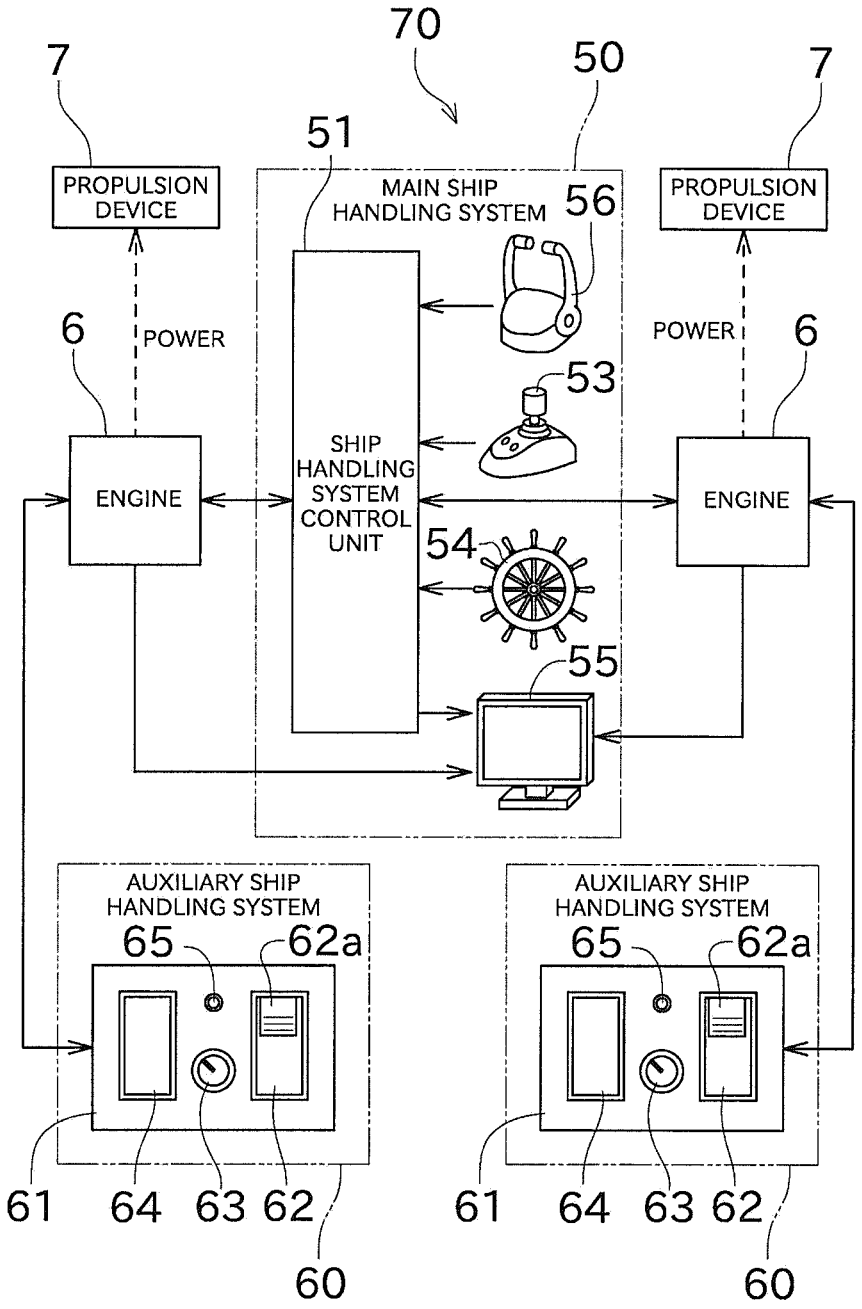
FIG. 7. A functional block diagram of another variation including two engines.

Next, a state where an abnormal condition occurs to the main ship handling system 50 and thereby the ship handling state is switched to the auxiliary ship handling state will be described with reference to FIG. 5 and FIG. 6. FIG. 5 is an explanatory drawing showing a state change of the engine control device 70 and processes accompanying the state change. FIG. 6 is a table showing the lighting patterns of the alarm lamp 65 and the contents in which each lighting patterns indicates.

A state in which an abnormal condition occurs to the main ship handling system 50 due to disconnection of a wire etc. and the changeover switch 62 was operated to switch to the auxiliary ship handling state, and thereafter the changeover switch 62 is returned to an original state will be described hereinafter.

The engine control device 70 in State 1 is in a main ship handling state, so that the main ship handling system 50 is in a normal state. In this satisfactory state, the alarm lamp 65 is turned out (see FIG. 6). After that, when the abnormal condition occurs to the main ship handling system 50 due to disconnection of a wire etc., or when the changeover switch 62 is turned on, a process to switch the ship handling state from the main ship handling state to the auxiliary ship handling state is started.

Specifically, the engine control unit 30 gradually reduces the engine rotation speed (a gradual change process, State 2). During this gradual change process, the alarm lamp 65 is turned on and off in a rather slow speed (for example, 1 Hz). When the abnormal condition occurs to the main ship handling system 50, it is possible that the engine control unit 30 and the display device 55 are also disconnected. Accordingly, the ship's operator can grasp that the unsatisfactory condition is occurred to the main ship handling system 50 by checking this alarm lamp 65. After that, when a target engine rotation speed of the engine control unit 30 becomes equal to or lower than a low idling speed (a predetermined limit rotation speed), the gradual change process is completed (State 3). When the gradual change process is completed, the alarm lamp 65 is turned on and off in a normal speed (for example, 2.5 Hz).

After the gradual change process is completed, if the main ship handling system 50 is in a satisfactory condition and the handle of the main operation unit 52 is pointing at the low idling speed or less, the state of the engine control device 70 is returned to State 1. On the other hand, when the gradual change process is completed (State 3), if the auxiliary ship handling system 60 is in a satisfactory condition and the changeover switch 62 is turned ON and the auxiliary operation unit 63 is pointing at the low idling speed or less, the state of the engine control device 70 is moved to the auxiliary ship handling state (State 4).

Since State 4 is in the auxiliary ship handling state, the engine rotation speed can be changed by using the auxiliary operation unit 63 provided on the auxiliary operation panel 61. Moreover, when the ship handling state is in the auxiliary ship handling state and the auxiliary ship handling system 60 is in a satisfactory condition, the alarm lamp 65 is turned on continuously. Accordingly, the ship's operator can grasp that a satisfactory ship handling is performed by using the auxiliary ship handling system 60.

After that, if the unsatisfactory condition of the main ship handling system 50 is dissolved and thereafter the changeover switch 62 is turned OFF, or if the ship's operator turned OFF the changeover switch 62 by an operational error, the main ship handling system 50 stops the engine 6 and shuts OFF the power sources of the engine 6, the main ship handling system 50, and the auxiliary ship handling system 60. However, only a part of above configuration (for example, engine 6) may be turned off the power.

After the power sources are shut OFF, the engine control unit 30 keeps working until a termination process is completed. At this time, the alarm lamp 65 turns on and off in a very slow speed (for example, 0.5 Hz). Accordingly, the user can grasp that the engine control unit 30 is in a termination process. Therefore, interrupting a main power source while the engine control unit 30 is working can be prevented. The alarm lamp 65 turns on and off in a very slow speed not only while the engine control unit 30 is in a termination process but also while the engine control unit 30 is in a starting process after the power source is turned ON.

As described above, when the ship handling system is switched from the auxiliary ship handling system 60 to the main ship handling system 50, the engine 6 is stopped and the power sources are shut down. With this configuration, occurrence of malfunctioning on the occasion of switching the ship handling state can be prevented.

After that, the engine is started according to the user's instructions, and the power source is turned ON. After that, the engine control unit 30 newly determines whether or not communication with the ship handling system control unit 51 is possible. If the engine control unit 30 determines that communication with the ship handling system control unit 51 is possible (the main ship handling system 50 is in a satisfactory condition), the state of the engine control device 70 is set to the main ship handling state (State 6). On the other hand, if the engine control unit 30 determines that communication with the ship handling system control unit 51 is impossible (the main ship handling system 50 is in an unsatisfactory condition), the state of the engine control device 70 is set to the auxiliary ship handling state (State 7).

When an unsatisfactory condition of the auxiliary ship handling system 60 is detected while the ship handling state is in the auxiliary ship handling state (State 4), a gradual change process of the auxiliary ship handling system 60 is performed. This gradual change process is the same as the gradual change process of the main ship handling system 50. However, a target engine rotation speed may be set lower. Moreover, when the main ship handling system 50 and the auxiliary ship handling system 60 are both in an unsatisfactory condition, the alarm lamp 65 turns on and off in a rapid speed (for example, 5 Hz).

As described above, the engine control device 70 includes the main operation unit 52, the auxiliary operation unit 63, the changeover switch 62, and an engine control unit 30. The main operation unit 52 is capable of performing the operation of changing the rotation speed of the propulsion engine 6 mounted on the ship 1. The auxiliary operation unit 63 is capable of performing the operation of changing the rotation speed of the engine 6 instead of the main operation unit 52. The changeover switch 62 is capable of performing the operation of switching between the main ship handling state in which the rotation speed of the engine 6 can be changed by operating the main operation unit 52 and the auxiliary ship handling state in which the rotation speed of the engine 6 can be changed by operating the auxiliary operation unit 63. The engine control unit 30 stops the engine 6 when the changeover switch 62 is operated to switch from the auxiliary ship handling state to a main ship handling state.

Accordingly, since the engine 6 comes to a stop by the engine control unit 30, the occurrence of a trouble when switching from the main ship handling state to the auxiliary ship handling state is surely prevented. For example, switching the ship handling state while the clutch is kept engaged can be prevented.

With respect to the engine control device 70 of this embodiment, the engine control unit 30 stops the engine 6 and shuts off at least the power source of the engine control unit 30 when the changeover switch 62 is operated to switch from the auxiliary ship handling state to the main ship handling state.

That is, when the ship handling state is switched from the auxiliary ship handling state to the main ship handling state, it is generally considered that an unsatisfactory condition is dissolved and now a main ship operation-side and a control unit-side can communicate satisfactory. Accordingly, the occurrence of an electric trouble or a failure on a program can be prevented by shutting down the power source of the engine control unit 30 and restarting the engine control unit 30.

With respect to the engine control device 70 of this embodiment, when the engine control unit 30 starts the engine 6 after stopping the engine 6, if the engine control unit 30 determines that the main ship handling system 50 (the main operation unit 52) is in a satisfactory condition, the ship handling state is set to the main ship handling state, whereas if the engine control unit 30 determines that the main ship handling system 50 is not in a satisfactory condition, the ship handling state is set to the auxiliary ship handling state.

Accordingly, whether the ship handling state is set to the main ship handling state or the auxiliary ship handling state is automatically determined based on the condition of the main ship handling system 50. Because of this configuration, even supposing that the ship handling state is switched from the auxiliary ship handling state to the main ship handling state while an unsatisfactory condition of the main operation unit 52 is not dissolved, the ship handling state can be automatically returned to the auxiliary ship handling state.

Next, another variation of the above-described embodiment will be described. In the description of this variation, there are cases when members that are configured in the same manner or in the similar manner as the above-described embodiment are given the same reference numerals in the drawings, and the description thereof is omitted.

In the above-described embodiment, one engine 6 is mounted on the ship 1. However, the number of engine 6 mounted is discretional. In this variation, two engines 6 are mounted. When two engines 6 are mounted, an accelerator lever (main operation unit) 56 including two levers is provided instead of the main operation unit 52. The accelerator lever 56 can operate a rotation speed of one of the engines 6 corresponding to an operation amount of one of the levers. The accelerator lever 56 can also operate a rotation speed of the other engine 6 corresponding to an operation amount of the other lever.

In this variation, the auxiliary operation panel 61 is provided corresponding to each engine 6. However, the auxiliary operation units 63 of two engines 6 may be arranged on one auxiliary operation panel 61. Basically, each of the engines 6 is controlled independently from the other engine 6. However, if disconnection of a wire arose merely between one of the engines 6 and the main ship handling system 50, the rotation speed of said engine 6 is reduced by a gradual change process, whereas a gradual change process is not performed on the other engine 6. Accordingly, the rotation speed of two engines are largely deviated.

With this regard, in this variation of the engine control device 70 (engine control unit 30), control for reducing the rotation speed is performed when a detection of the fact that the other engine 6 has performed the gradual change process (or disconnection of a wire has arose) is received. The configuration of the detection of the fact that the other engine 6 has performed the gradual change process is discretional. For example, when the engines 6 are configured in such a manner that the engines 6 can communicate with each other through a wiring (not shown), the fact that the gradual change process is performed may be detected. Moreover, when one engine control unit is configured to control two engines 6, the fact that the gradual change process is performed to the other engine can surely be grasped.

Accordingly, the rotation speed of two engines 6 mounted on the ship can be uniformed. Accordingly, outputs of left and right propulsion devices 7 can be uniformed.

Although preferred embodiments of the present invention have been described above, the above-described configuration can be modified, for example, as follows.

In the above configuration, the main operation unit 52 is formed into a lever type, and the auxiliary operation unit 63 is formed into a dial type. However, the shape and operation style of each operation unit are discretional, that is, these can be discretionary changed.

At least a part of process performed by the engine control unit 30 may be alternatively performed by the ship handling system control unit 51. In the above-described configuration, the ship handling system control unit 51 and the engine control unit 30 are separate devices disposed at physically separate positions. However, these units can be configured as one device.

The engine 6 can also be used in a propulsion mechanism that is not an above-mentioned sail drive. For example, the engine 6 may be used in a stern drive. In the stern drive type configuration, a power transmission device to which a propeller is attached directly is disposed rearward of the ship body, and the power of a ship engine is transmitted from a power transmission shaft attached rearward of the ship engine to the power transmission device. The engine 6 may also be used in an angle type in which a propeller shaft is attached rearward of a power transmission device extending obliquely downward. The engine 6 may also be used in a parallel type in which a propeller shaft is attached rearward of a power transmission device in a parallel manner. The ship is not limited to a sailing ship. The ship may also be a steamship.

DESCRIPTION OF THE REFERENCE NUMERALS

1 ship
6 engine
7 propulsion device
30 engine control unit (control unit)
50 main ship handling system
51 ship handling system control unit
52 main operation unit
56 accelerator lever (main operation unit)
60 auxiliary ship handling system
61 auxiliary operation panel
62 changeover switch (changeover operation unit)
63 auxiliary operation unit
70 engine control device

What is claimed is:

1. An engine control device comprising:

a main operation unit capable of performing an operation of changing a rotation speed of a propulsion engine mounted on a ship;

an auxiliary operation unit capable of performing an operation of changing the rotation speed of the engine instead of the main operation unit;

a changeover operation unit capable of performing an operation of switching between a main ship handling state in which the rotation speed of the engine can be changed by operating the main operation unit and an auxiliary ship handling state in which the rotation speed of the engine can be changed by operating the auxiliary operation unit; and a control unit that stops the engine when the changeover operation unit is operated to switch from the auxiliary ship handling state to the main ship handling state.

2. The engine control device according to claim 1, wherein the control unit stops the engine and shuts off at least a power source of the control unit when the changeover operation unit is operated to switch from the auxiliary ship handling state to the main ship handling state.

3. The engine control device according to claim 1, wherein when the control unit starts the engine after stopping the engine, if the control unit determines that the main operation unit is in a satisfactory condition, the ship handling state is set to the main ship handling state, whereas if the control unit determines that the main operation unit is not in a satisfactory condition, the ship handling state is set to the auxiliary ship handling state.

4. The engine control device according to claim 1, wherein at least two propulsion engines mounted on the ship are provided, when the control unit determines that the operation of the main operation unit toward one of the engines cannot be performed satisfactorily, the control unit reduces the rotation speed of said engine, while reducing the rotation speed of the other engine.

* * * * *